United States Patent [19]

Varady et al.

[11] 4,216,953

[45] Aug. 12, 1980

[54] PAPER FEEDING DEVICE

[75] Inventors: Joseph S. Varady, Smithfield; Robert C. Knights, Balgowlah, both of Australia

[73] Assignee: Hafotu Pty. Limited, Sydney, Australia

[21] Appl. No.: 897,470

[22] Filed: Apr. 18, 1978

[30] Foreign Application Priority Data

Apr. 20, 1977 [AU] Australia ..... PC9814

[51] Int. Cl.[3] ..... B65H 3/08; B65H 1/24

[52] U.S. Cl. ..... 271/11; 271/30 R; 271/98; 271/104; 271/273; 400/627

[58] Field of Search ..... 271/4, 5, 6, 11, 273, 271/242, 245, 246, 247, 265, 266, 229, 272, 264, 274, 275, 198, 98, 30 R, 104, 105; 400/624, 625, 627, 629, 636, 617

[56] References Cited

U.S. PATENT DOCUMENTS

| | | | |
|---|---|---|---|
| 1,077,400 | 11/1913 | Droitcour | 271/197 |
| 1,560,570 | 11/1925 | Hammersmith | 271/229 |
| 1,861,605 | 6/1932 | Maass | 271/104 |
| 2,135,541 | 11/1938 | Stuart et al. | 400/625 |
| 2,406,205 | 8/1946 | Davidson et al. | 271/242 X |
| 3,747,918 | 7/1973 | Margulis et al. | 271/265 X |

*Primary Examiner*—Bruce H. Stoner, Jr.
*Attorney, Agent, or Firm*—Ladas & Parry

[57] ABSTRACT

A paper supply device for a machine such as an electric typewriter or word processor, the device comprising a self-supporting housing for location behind said machine and separate therefrom. The device includes a pair of driven rotatable rollers for frictionally engaging and advancing an item of stationery so that the leading edge thereof extends forwardly and out of the housing, said rollers being rotated during part of each cycle of operations of said device and being stationery and out of frictional engagement with said item of stationery during a subsequent part of each cycle of operations, thereby removing frictional drag on said item of stationery when it is engaged by and drawn into said machine.

6 Claims, 10 Drawing Figures

PAPER FEEDING DEVICE

This invention relates to feeding apparatus for stationery to typewriters and printing machines. Although the apparatus may be applied with advantage to manually operated typewriters, it has especial application to automatic machines such as word processors and magnetic card typewriters.

It is a common practice to assign a single attendant to a battery of say four word processors, or automatic repetition typewriters. It is the duty of the attendant to alter the program, or magnetic card, associated with such machines as required and to supply stationery thereto. The most time-consuming duty involves stationery supply which frequently requires accurate timing of the supply. To this end the practice has developed to attach the separate pieces of stationery, such as pages and envelopes, accurately spaced to an endless backing strip and after printing, or typing, to remove same. While this practice requires far less manual attendance, attachment and removal of the pieces of stationery to and from the backing strip together with the supply of the latter continues to add cost to the printing operation.

The electrical typing and printing machines with which the stationery feeding apparatus are usually associated involves a lease or maintenance agreement with the machine supplier which often becomes void if any unauthorised electrical, or even mechanical, connection be made to the machine. Thus, almost invariably paper feeding devices which have hitherto been used or proposed for typewriters, copiers and processors can only be applied at the risk of the operator because of their mechanical or electrical reliance upon functions of these machines, thereby entailing some form of interconnection. Furthermore, in such instances the transfer of the stationery feeding apparatus from one machine to another, as required, cannot be performed too readily.

It is the main object of the invention to provide apparatus for supply of stationery to printing or typing machines which avoids much of the manual effort referred to above.

Another object is to provide such apparatus in an autonomous form, i.e. in a form where it functions both mechanically and electrically almost completely independently of the machine with which it is associated.

Accordingly, the invention provides a device for supply of stationery to a machine such as an electric typewriter which machine incorporates means for advancement of stationery therethrough, said device comprising a housing frame having a front end portion through which stationery is advanced, a driving rotatable roller means within said housing frame for frictionally advancing in repeated cycles the leading edge of successive items of said stationery to and beyond said front end portion for a predetermined distance, said roller means being rotated for a part of each operating cycle of said device while frictionally engaged with a respective item of said stationery and by the same amount in each of said cycles whereby each successive item of said stationery is advanced the same distance by said roller means, and said roller means being frictionally disengaged from said stationery item during another part of each of said cycles, and uni-directional friction means for grasping said stationery item to restrain return of said item, whereby further advancement of said stationery item by said advancement means of said machine is substantially unimpeded.

The invention will be described in greater detail with reference to a preferred embodiment illustrated in the accompanying drawings, in which.

Figure 1:
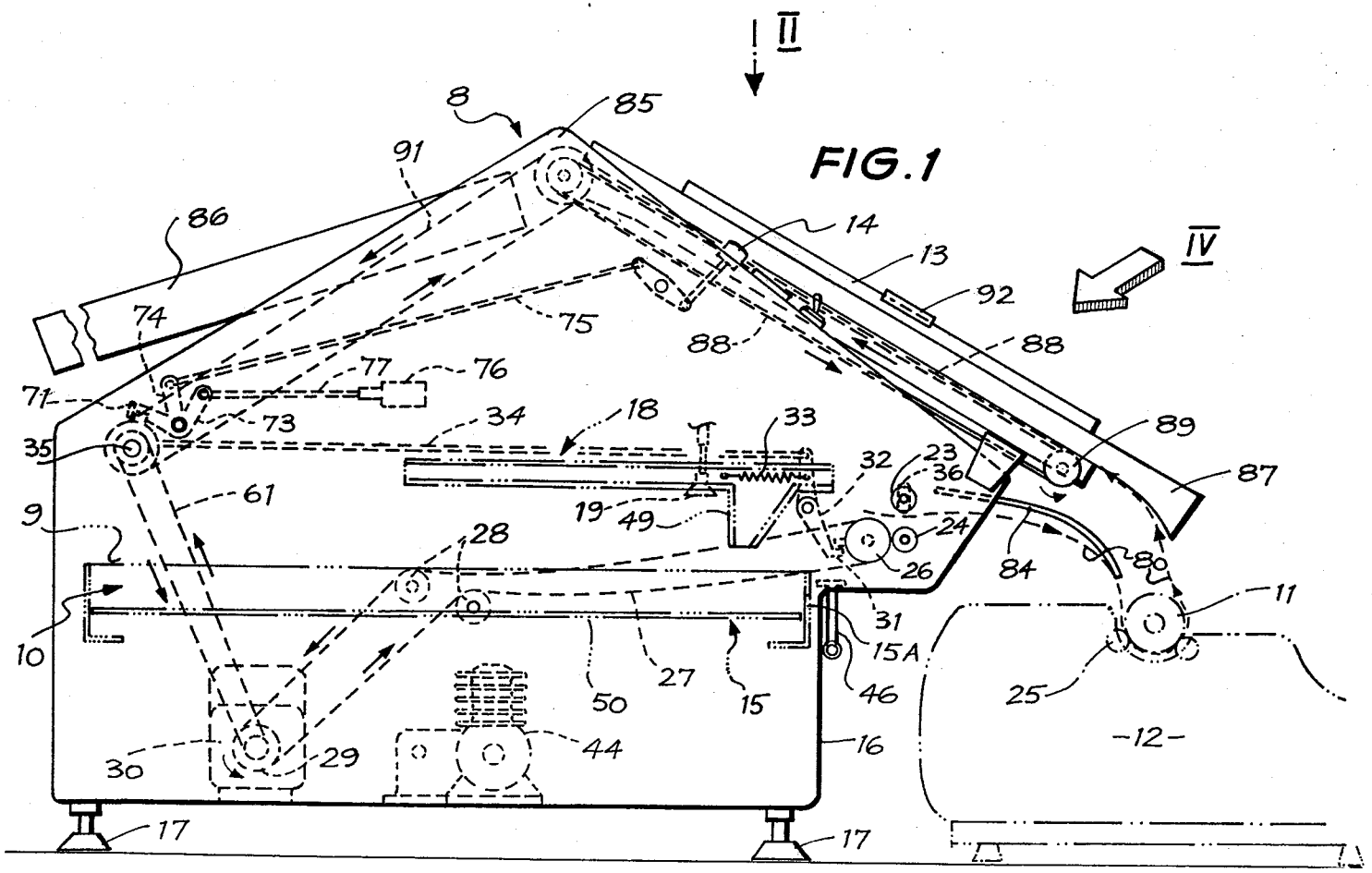
FIG. 1 shows the embodiment of the stationery supply device in side elevation partly diagrammatically and with some parts being omitted for clarity.
Figure 2:
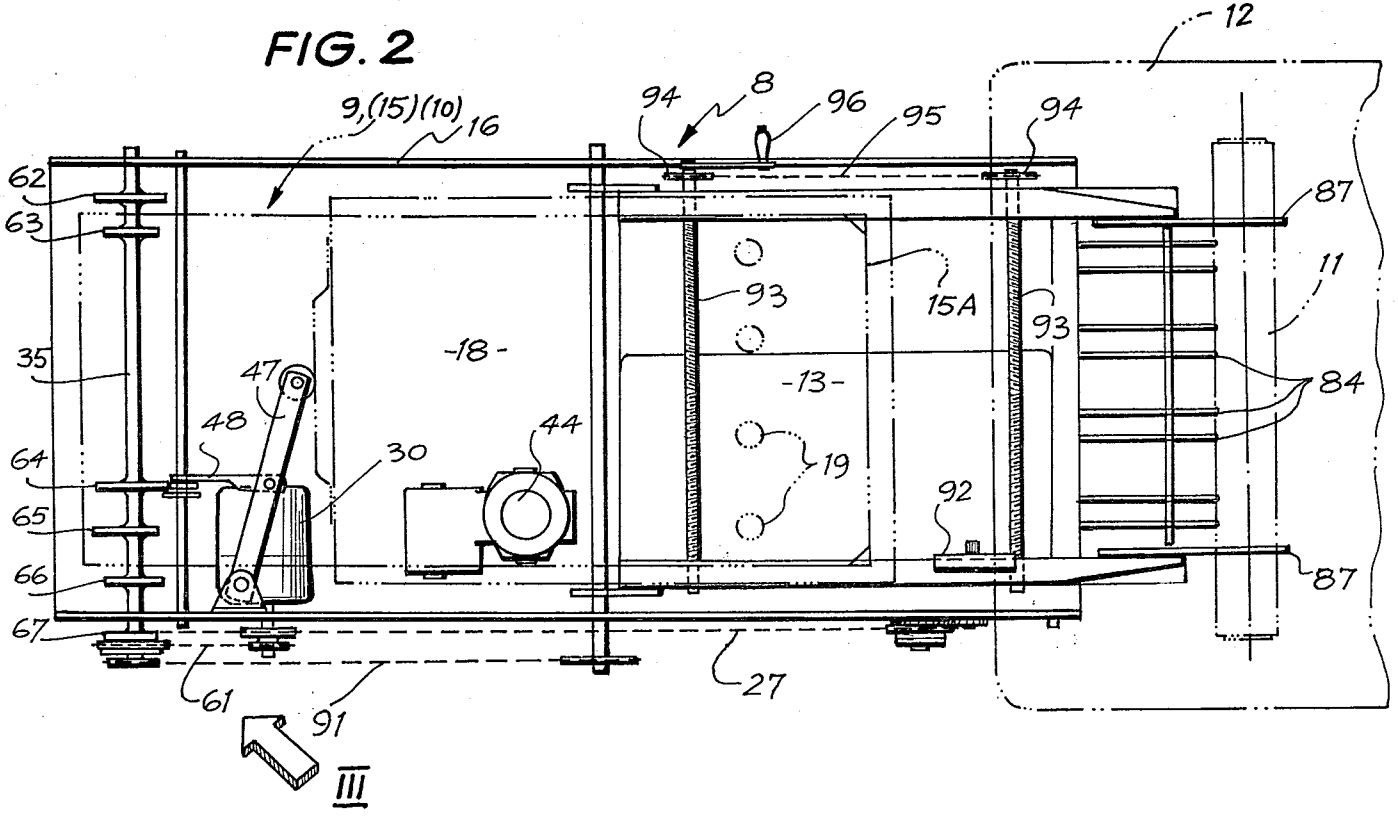
FIG. 2 is a plan view as indicated by the arrow II in FIG. 1.

With reference to FIGS. 1 and 2, the stationery supply device 8 shown is adapted for fully automatic operation whereby pieces of stationery 9 from a stacked supply 10 are fed to the platen 11 of a typewriter 12 which controls advancement of the stationery 9 through the machine 12. Stationery 9 after typing, which is then advanced out of the machine 12, is received in a transport frame 13 and its presence therein detected in a manner described hereafter in order to control the initiation of supply of a fresh piece of stationery 9 to the typewriter 12. It will be readily appreciated that feeding of stationery 9 to the machine 12 may be controlled under manual selection by omitting the detector means and/or the transport frame 13 and providing instead a manually operable switch button 14. In this embodiment the device 8 may be provided as an accessory for a typewriter, word processor, printing machine, or the like, and consists of a storage tray 15 for holding in stacked form a plurality of pieces of stationery 9 such as pages or envelopes which may be supplied in any one of numerous sizes. This tray 15 is supported upon a casing or housing 16 which will stand upon feet 17 separate from and to the rear of the typewriter 12 and has means for resiliently elevating its floor (to be described hereafter) for progressively substituting for the uppermost stationery piece 9 all of the remaining pieces in the stack 10. A feed frame 18 is suspended above the storage tray 15 for reciprocation between advanced and retracted positions. A row of suction heads 19 (FIGS. 1, 2 and 5) is attached to a forward end 18A of the feed frame 18 and in the retracted position thereof (as shown in FIGS. 1 and 2 ) is poised over the head portion of the uppermost piece of stationery 9 in the the stack 10. A spaced pair of stationery side rails 20 are positioned to opposite sides of the feed frame 18 and provide confronting horizontal tracks 21 to accommodate lateral rollers 22 on the feed frame 18 to permit the latter to move between its advanced and retracted positions.

A pair of insertion rollers has one roller 23 overlying the other 24 and vertically displaceable thereto. The leading edge of a piece of stationery 9, such as paper, is inserted between these rollers 23 and 24 during advancement of the feed frame 18. Subsequently, as will be described hereafter, the upper roller 23 closes onto the lower 24 and the latter is then driven to move the leading edge of the paper 9 into the platen mechanism where it is grasped between the platen 11 and idler roller 25 and continues its movement through the typewriter 12 under the control of the platen 11. The roller 24 is gear driven through a clutch from a sprocket 26 which in turn is driven by a chain 27 connected via idlers 28 to the drive sprocket 29 of a motor 30 in the base of housing 16. The clutch associated with the sprocket 26 is controlled from a spur 31 on a bellcrank 32 normally urged into operative engagement with said clutch by a spring 33 to disconnect drive to the roller 24. A pushrod 34 connected to the bellcrank 32 responds to cam control from a timing camshaft 35 to be described later with reference to FIG. 3, to effect timed rotation of roller 24. Elevation of the upper roller 23 which is captured within opposite slots 36 is also controlled in timed sequence from the camshaft 35 through a pushrod 37 (FIG. 3) and a wedging finger 38.

Figure 5:
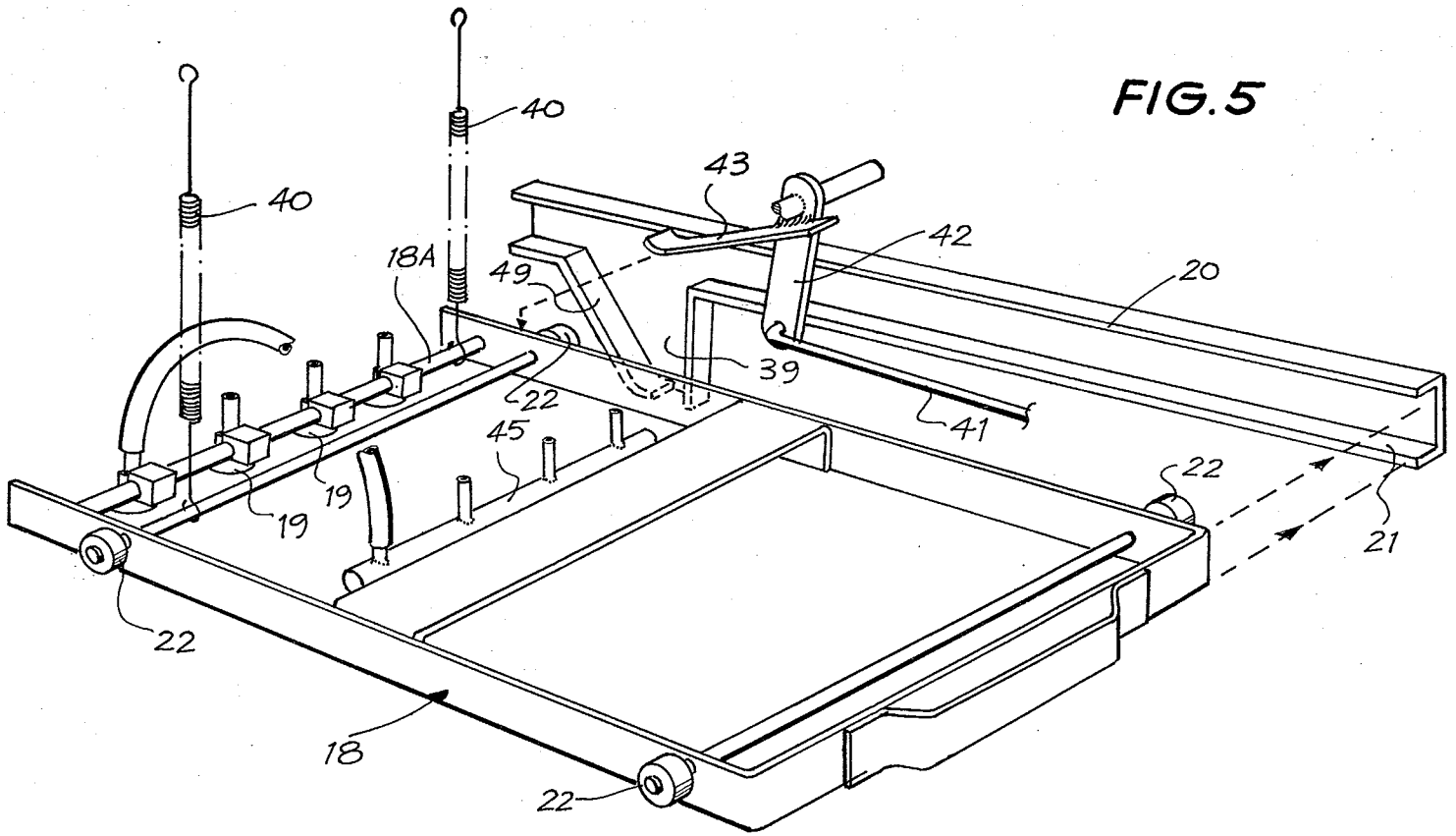
FIG. 5 is an exploded perspective of the paper feed frame of the device, with parts omitted for clarity.

With reference to FIG. 5 the rollers 22 at the forward end 18A of the feed frame 18 in the retracted position of the latter overly a gap 39 in each track 21. The tension in springs 40 retains the feed frame 18 horizontally in its normal rest position and a further pushrod 41 responding to the timing camshaft 35 through a link 42 depresses a pair of levers 43 which engage with respective opposite sides of the feed frame 18 to force its forward end downwardly toward the stack of stationery 9 in the tray 15. The suction cups 19 are thus engaged with the upmost piece of stationery 9. The frame 18 is then returned to the horizontal by restoration of the levers 43 and advanced by a roller-equipped pivoted bracket 47 displaced by a further pushrod 48 controlled in timed sequence from the camshaft 35. An inclined guide 49 for forward rollers 22 assists return of the frame 18 to the horizontal when it is urged forwardly by the bracket 47.

Figure 6A:
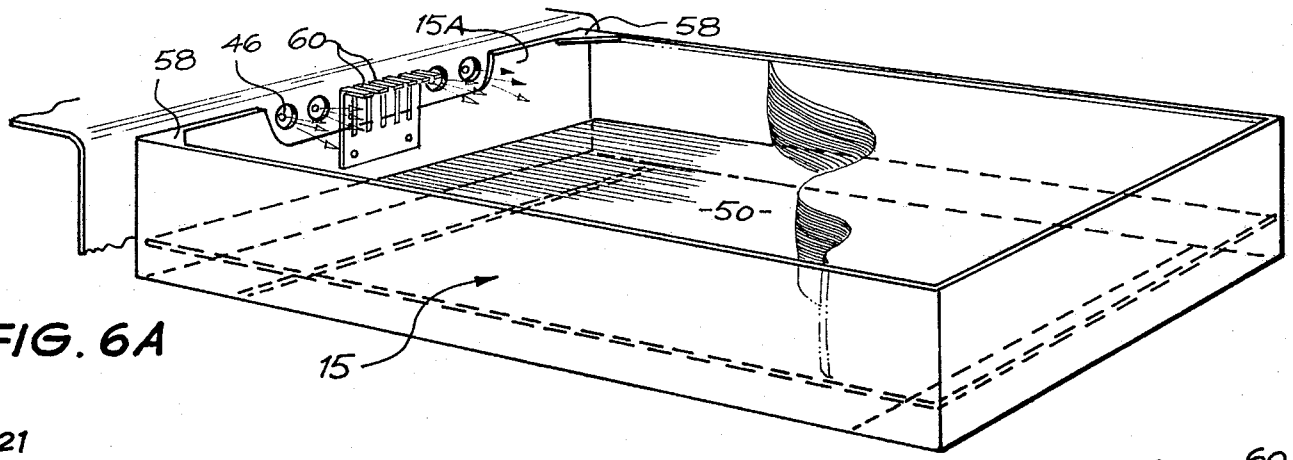
FIG. 6A is a perspective of the paper storage tray.
Figure 6C:
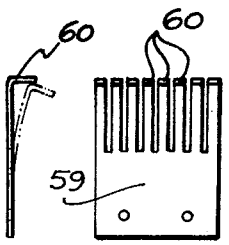
FIG. 6C shows a detail of a paper retaining comb on said tray.
Figure 6B:
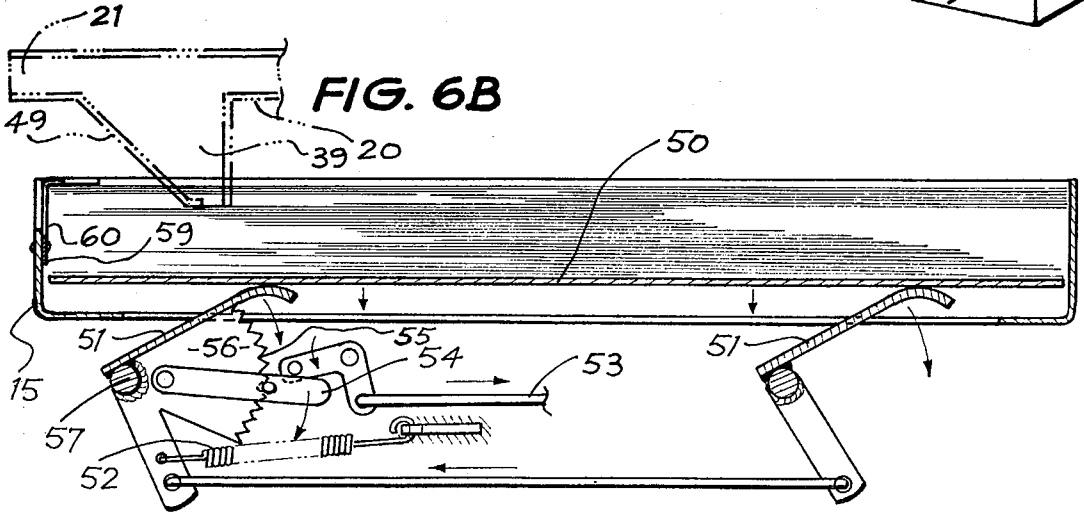
FIG. 6B is a side sectional view thereof together with its floor elevating mechanism.

Special measures may be taken to ensure that with elevation and advancement of the frame 18 a single piece of stationery 9 is removed from the tray 15 and placed between the rollers 23 and 24. To this end, the floor 50 (see FIG. 6B), being normally urged upwardly through an interconnected pair of pressure fingers 51 acted upon by tension spring 52, is lowered momentarily by a pushrod 53. The latter is connected by a pawl 54 to the teeth 55 of a cam sector 56 fixed upon a common shaft 57 with the forward pressure finger 51. Thus, when actuated by the pushrod 53, or a hand lever (not shown) fixed upon shaft 57, the cam sector 56 causes lowering of the fingers 51 and the floor 50 of the tray 15. The stack 10 of stationery 9 is normally forced up against the underside of the paper strippers 58 to compact the stack 10, and when the floor is lowered the pressure on the stack 10 is relieved and separation of the stationery paper is greatly facilitated with the assistance of an air blast through jets 46. Furthermore, a spring leaf 59 (FIG. 6C) having a row of inturned paper separator fingers 60 is mounted at the forward end 15A of the tray 15 to engage the stack 10 and through their resiliency interpose themselves between the top and second page of stationery 9.

A compressor 44 (FIG. 1) is driven from the motor 30 to supply suction through a manifold 45 (FIG. 5) to the suction cups 19 at intervals also timed by the camshaft 35. Air under pressure is also obtained in similar manner at timed intervals and applied through the jets 46 for separation of the uppermost sheets of stationery 9 at the forward end 15A of the storage tray 15.

Figure 3:
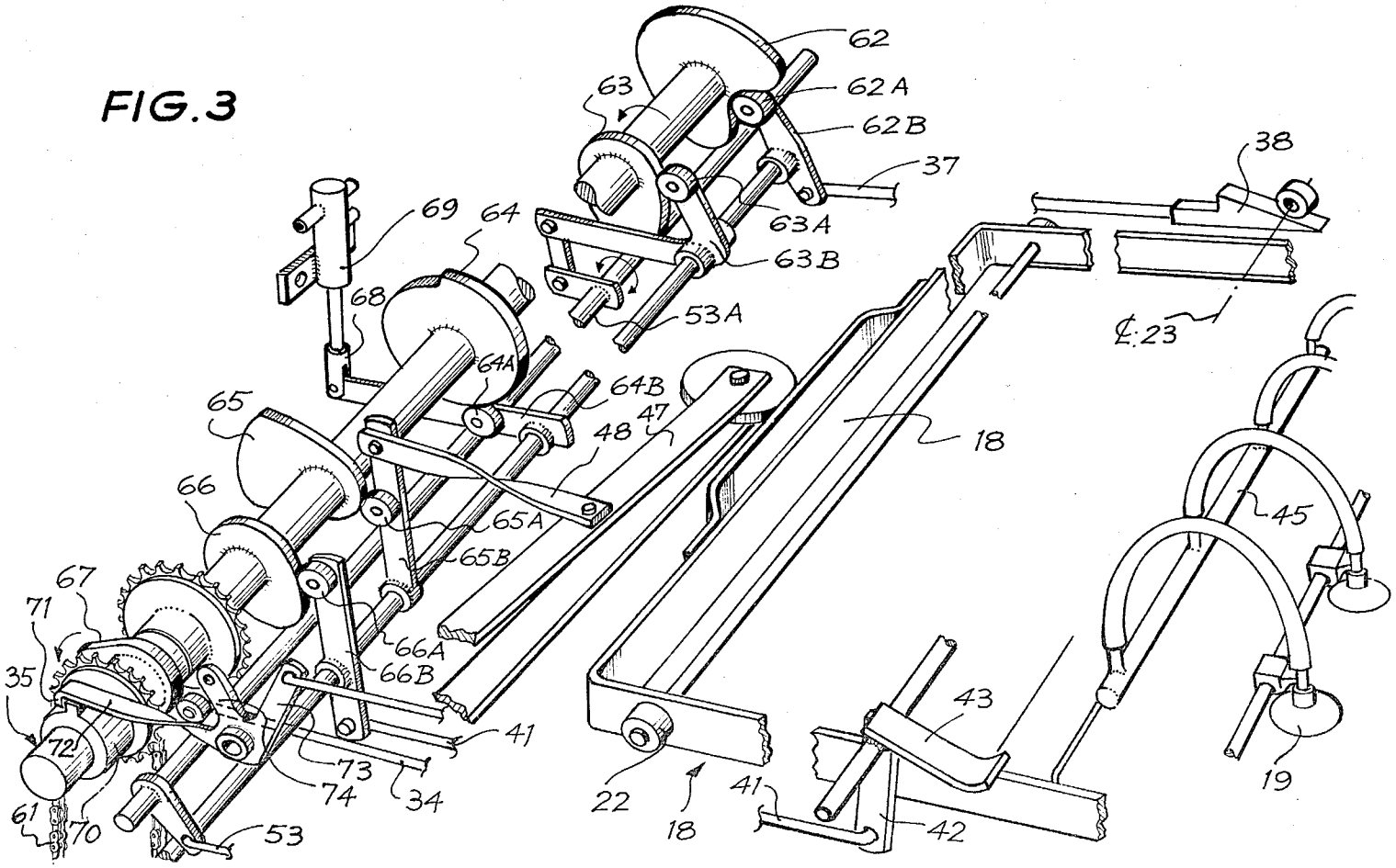
FIG. 3 is a diagrammatic view of the controlling camshaft of the device viewed on the line of the arrow III in FIG. 2.
Figure 4:
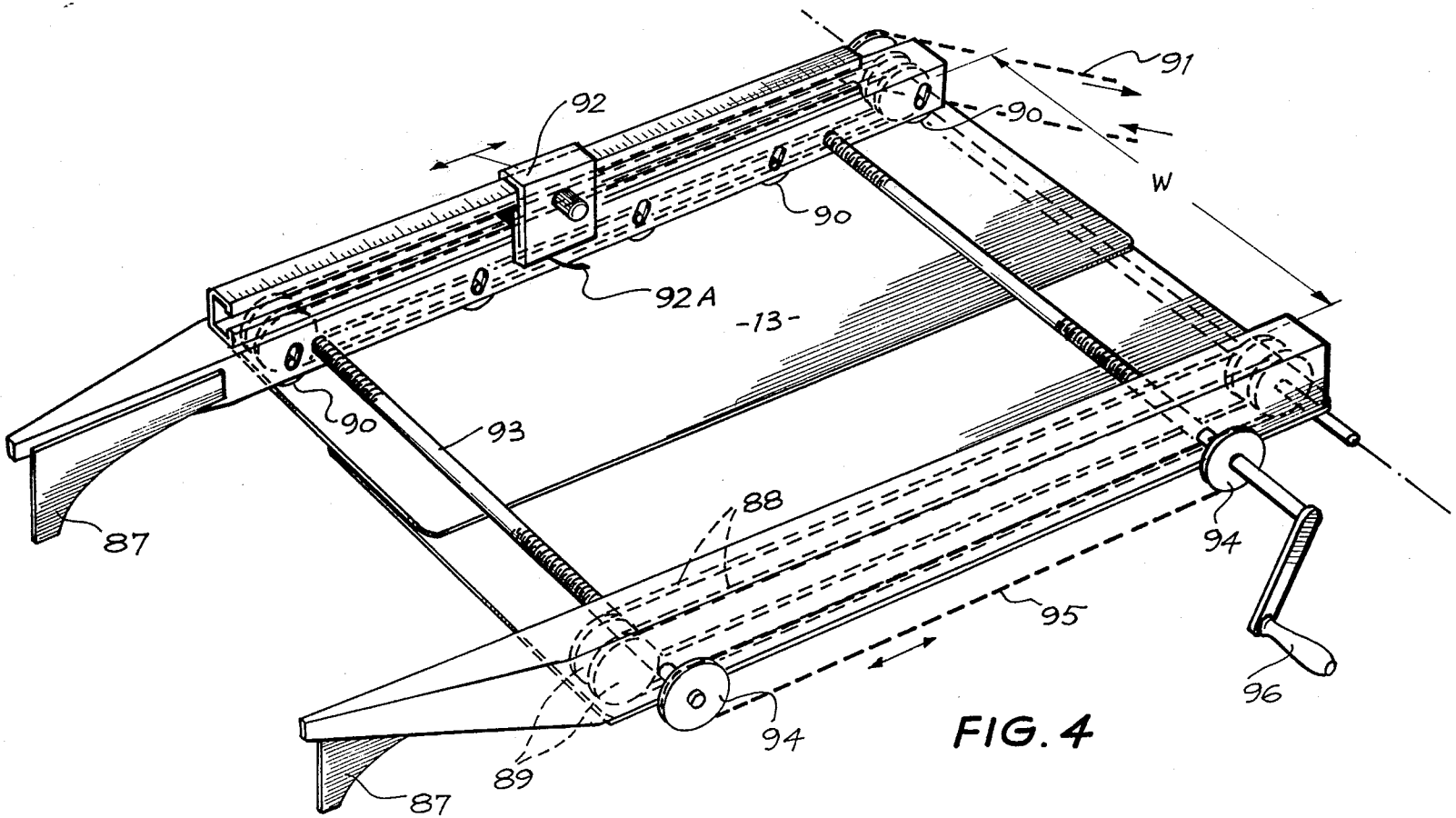
FIG. 4 is a perspective view of the paper receiving transport frame of the device viewed on the line of arrow IV in FIG. 1.

Reference is now made to FIG. 3 showing the timing camshaft 35, in the normal rest condition of the device 8, connected for drive by a chain, or belt, 61 from the electric motor 30 and mounting five separate cams 62 to 66 engageable by respective cam followers 62A to 66A fixed on lever arms 62B to 66B. Cam 62 operates the wedging finger 38, the cam 63 the pushrod 53 through shaft 53A and therefore the pressure fingers 51 for lowering the floor 50 of the stationery storage tray 15, and cam 64 through lever 64B displaces the control plug 68 in the pneumatic valve 69 to time the application of suction and pressure to the cup 19 and the jets 46, respectively. The cam 65 controls pushrod 48 and thus the advance and retract action of the feed frame 18 while the cam 66 through pushrod 41 serves to control lowering of the feed frame via levers 43. The clutch associated with sprocket 26 is operated via pushrod 34 from a further cam 67. A clutch 70 is shown at the left hand end of camshaft 35 and is operated by a spur 71 on one end of a bellcrank 72 provided with two control arms 73 and 74. Until the clutch 70 is engaged the camshaft 35 is stationary and this can be effected to commence a cycle of operations either by depression of the manual switch button 14, which through rod 75 and arm 74 engages the clutch, or automatic energization of solenoid 76, which through rod 77 and arm 73 similarly engages the clutch.

The timing of the cams 62 and 67 is such as to achieve the following sequence of operations: lowering momentarily of the feed frame 18 with the suction heads 19 applying suction to the cups 19, lowering the floor 50 of the paper tray 15, applying air under pressure through the jets 46, releasing the feed frame 18 for return to the horizontal, driving forward the feed frame 18 to deliver a page of stationery 9 through the nip of the pair of insertion rollers 23 and 24, lowering of the upper roller 23 to grasp the page, advancing said page to the platen 11 by rotation of the roller 24, and restoring of the feed frame 18 to its rest position.

The device 8 so far described concerns the apparatus utilized for the insertion of stationery sheets 9, or items, into the platen 11 of the typewriter 12 and reference will be made hereafter to the apparatus serving to receive sheets 9 after typing from the platen 11, as well as the electrical interconnection therebetween which effects fully automatic repetitive feeding of stationery 9. As presently described, however, the device 8 is capable of supplying stationery 9 as required to the typewriter under manual selection by depression of the switch button 14. Of course, in most instances some arrangement will be required for receiving and storing the stationery progressing from the platen 11.

Figure 7B:
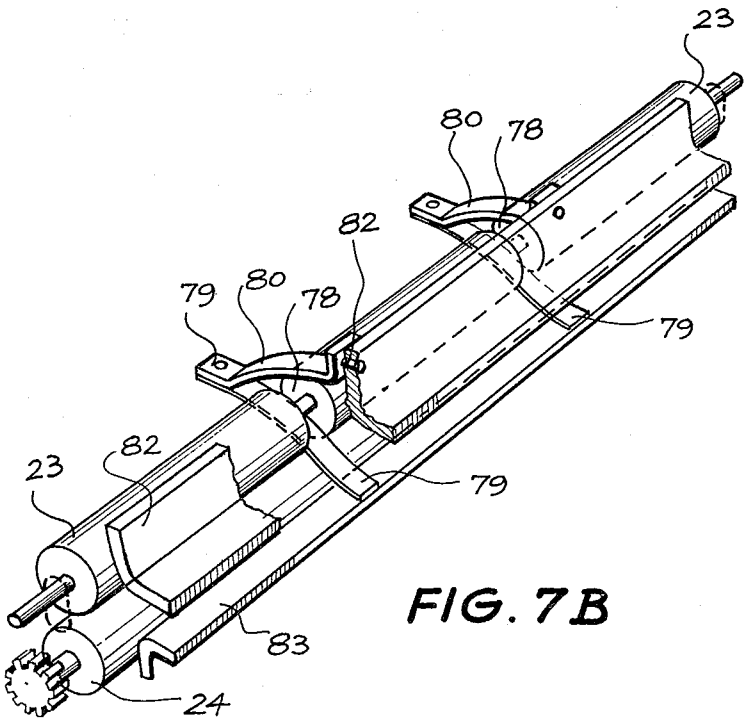
FIG. 7B is a perspective partly broken view of said insertion roller assembly.
Figure 7A:
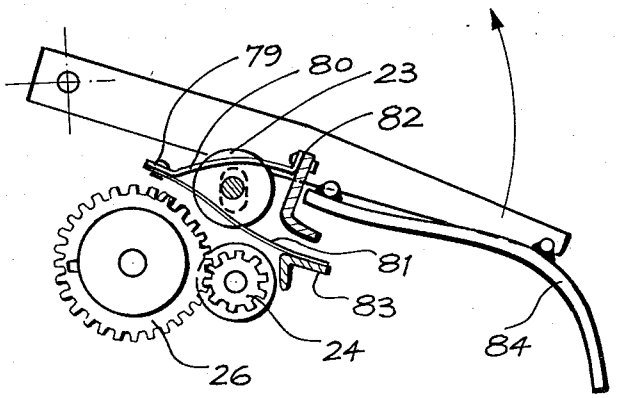
FIG. 7A is an end elevation partly in section of the assembly of the paper insertion rollers of the device.

Almost invariably some measure will be required to ensure that correct registration of stationery 9 with the platen 11 occurs although the stationery 9 may not be squarely presented to it. It is conventional to achieve this by forcing the leading edge of the stationery 9 into the nip between the platen 11 and idler roller 25 with such force as to bow the paper. It will be retained in this condition pending its advancement by the platen 11. It will be seen from the embodiment described above that in the rest condition of the device 8 the upper roller 23 is elevated from the roller 24 and thus the bow in the paper will be lost. This could be overcome by the provision of an additional pair of rollers to maintain an advancing force upon the stationery 9, but a certain degree of inertia will be possessed by such additional rollers which could interfere with the advancement of the stationery 9 by the platen 11. According to this invention, with reference to FIG. 7, the upper roller 23 has spaced gaps 78 through which light spring leaves 79 extend in longitudinal alignment with the path 80 of the feed of stationery 9. Each spring leaf 79 is composed of two bowed arms 80 and 81, arm 80 of which is anchored to a bracket 82 supported between the side plates of the housing 16 while the outer end of arm 81 rests upon the upper surface of a platform 83 also supported by the housing 16. Stationery 9 passing between the nip of rollers 23 and 24 passes between the arm 81 and the platform 83 and the outer end of the former is slightly downturned so as to bite into the upper surface of the stationery 9 to prevent its return from the platen 11. On the other hand, stationery 9 may be advanced beneath the arms 81 of springs 79 with practically no drag whatever. The leading edge of stationery 9 passing beneath springs 79 is engaged by an arcuate comb 84 and guided downwardly into engagement between the platen 11 and its idler roller 25.

The paper transport frame 13 is supported upon the housing 16 in an overhead position to the feed frame 18 on the forward inclined surface of a triangular shaped top 85 of the housing 16. A receiving tray 86 is supported on the rear inclined surface of the housing top 85. Stationery 9 proceeding from the platen 11 of typewriter 12 will pass via a path 80 beneath inlet guide plates 87 with its lateral edges located within slots in the transport frame 13. A pair of rubber belts 88 reeved over pulleys 89 at opposite ends of the transport frame 13 are accommodated within each lateral slot whereby the marginal edge portions of stationery 9 pass thereover. A series of rollers 90 mounted on spindles captured in vertically inclined slots at opposite sides of the transport frame 13 under gravity apply a force to the upper edges of the marginal edge portions of stationery 9. Thus, the stationery 9 is drawn by the moving belts 88 up the transport frame 13, over the top 85 of the housing 16 to be deposited in the receiving tray 86. Drive for the belts 88 is obtained from a belt or chain 91 permanently connected with the motor 30 so that the belts are in movement whenever power is applied to the device 8.

In order to effect fully automatic operation of the device 8, as referred to above, a microswitch 92 having an actuator 93 is adjustably mounted to one side of the transport frame 13. The actuator 93 lies in the path 80 of stationery 9 proceeding up the inclined surface of the transport frame 13 and is engaged by the leading edge of such stationery 9 to operate the microswitch 92 to cause operation of solenoid 76 (FIG. 1). Therefore, it can be seen that if the position of the microswitch 92 upon the frame 13 is correctly adjusted according to the length of the stationery item 9 the spacing between the trailing edge of one item and the leading edge of the next item as they pass through the typewriter 12 can be manually predetermined. Also to provide for varying widths of stationery 9 to be handled by the device 8 the transport frame 13 is comprised of two longitudinally divided halves capable of telescoping together to reduce the spacing between the drive belts 88 on one side from those on the other side. This is effected by means of a pair of turnbuckles 93 spaced longitudinally on the frame 13 which are driven by respective sprockets 94 connected together by chain 95 and manually operable by crank handle 96.

From the above description it will be clear that the entire stationery supply device 8 is self-contained and autonomous. That is it does not require connection either physically or electrically with the typewriter 12, or printer, with which it is working. As a result operation of the typewriter can in no way be affected by the device 8, and it can quickly be placed into service or removed therefrom. The practice to be employed will be to place the housing 16 close behind the machine 12 to be serviced by the device 8 so that a first item 9 of stationery protruding forwardly of the housing 16 has its leading edge located within the nip between the platen 11 and its idler roller 25. The item 9 can be advanced from the storage tray 15 to this position by manually depressing button 14. The correct relative position between the housing 16 and the machine 12 occurs when the item 9 is buckled or bowed, thus ensuring square registration with respect to the platen 11.

By the use of the stationery supply device 8 of this invention it will be found that accurate spacing between successive stationery pieces 9 at the platen 11 can be attained and any desirable adjustment to improve this accuracy can be readily achieved by positional adjustment of the microswitch 92 on the transport frame 13.

Where "pieces" or "items" of stationery are referred to herein it is to be understood that this term is also intended to include sets of stationery such as an original sheet plus duplicate copy or copies.

A preferred embodiment has been described in the foregoing passages but it should be understood that other forms, modifications and refinements are feasible within the scope of this invention.

What we claim is:

1. A device for supply of stationery to a machine such as an electric typewriter which machine incorporates means for advancement of stationery therethrough, said device comprising a housing frame having a front end portion through which stationery is advanced, a driving rotatable roller means within said housing frame for frictionally advancing in repeated cycles the leading edge of successive items of said stationery to and beyond said front end portion for a predetermined distance, means for rotating said roller means for a part of each operating cycle of said device while said roller means is frictionally engaged with a respective item of said stationery and by the same amount in each of said cycles whereby each successive item of said stationery is advanced the same distance by said roller means, means to bring about frictional disengagement of said roller means from said stationery item during another part of each of said cycles, and unidirectional friction means for grasping said stationery item to restrain return of said item, whereby further advancement of said stationery item by said advancement means of said machine is substantially unimpeded, and further comprising an open topped storage tray within said housing for a stack of stationery items, a paper feed frame above said tray mounted for reciprocation between a first position, whereat the stationery item uppermost in said stack is removed from said stack by said frame, and a second, forward position whereat said removed item is inserted through said roller means, a mechanism resiliently supporting the floor of said storage tray, and control means for said mechanism to effect lowering of said floor immediately prior to removal of said uppermost item to release compression on said stack and thereby to facilitate said removal.

2. A device as claimed in claim 1, wherein said unidirectional friction means are a pair of co-operating surfaces provided with a nip and engaging with opposite faces of said stationery item, said surfaces being so shaped that they tend to close together with return movement of said stationery item and they tend to separate with advance movement thereof.

3. A device as claimed in claim 2, wherein said unidirectional friction means is a platform and several spring leaves spaced across the path of advancement of said stationery item and urged towards said platform.

4. A device as claimed in claim 1, wherein said roller means comprises two juxtaposed rollers, one of said rollers being rotatably driven and the other of said rollers being mounted for controlled spacing displacement with respect to said one roller.

5. A device as claimed in claim 1, wherein said feed frame has suction cups to engage and remove said uppermost item of stationery, and jets of compressed air at a forward end of said storage tray are directed laterally at the edges of the stationery items at and near the top of said stack also to facilitate said removal.

6. A device as claimed in claim 1, further comprising a spring leaf having inturned fingers and located in said storage tray laterally of a forward edge of said stack of stationery items, said fingers bearing resiliently against said edge to become interposed between the two uppermost items of stationery in said stack during said removal to ensure one of said items at a time is removed.

* * * * *